US011114756B2

(12) United States Patent
Chuang et al.

(10) Patent No.: US 11,114,756 B2
(45) Date of Patent: Sep. 7, 2021

(54) ANTENNA SYSTEM

(71) Applicant: Wistron Corp., New Taipei (TW)

(72) Inventors: Shih Ming Chuang, New Taipei (TW); Jyun Nian Lin, New Taipei (TW); Chih-Ming Chen, New Taipei (TW)

(73) Assignee: WISTRON CORP., New Taipei (TW)

( * ) Notice: Subject to any disclaimer, the term of this patent is extended or adjusted under 35 U.S.C. 154(b) by 128 days.

(21) Appl. No.: 16/751,274

(22) Filed: Jan. 24, 2020

(65) Prior Publication Data

US 2021/0184345 A1 Jun. 17, 2021

(30) Foreign Application Priority Data

Dec. 13, 2019 (TW) ..... 108145692

(51) Int. Cl.

| | |
|---|---|
| ***H01Q 1/24*** | (2006.01) |
| ***H01Q 1/52*** | (2006.01) |
| ***H01Q 21/30*** | (2006.01) |
| ***H01Q 9/04*** | (2006.01) |
| ***H01Q 21/28*** | (2006.01) |
| ***H01Q 13/10*** | (2006.01) |

(52) U.S. Cl.

CPC ..... *H01Q 1/521* (2013.01); *H01Q 1/243* (2013.01); *H01Q 9/0421* (2013.01); *H01Q 13/106* (2013.01); *H01Q 21/28* (2013.01); *H01Q 21/30* (2013.01)

(58) Field of Classification Search

CPC ..... H01G 1/243; H01G 9/0421; H01G 13/106

See application file for complete search history.

(56) References Cited

U.S. PATENT DOCUMENTS

2017/0162948 A1 6/2017 Wong et al.
2020/0021021 A1* 1/2020 Lin ..... H01Q 5/20

FOREIGN PATENT DOCUMENTS

TW 201721974 A 6/2017

OTHER PUBLICATIONS

Chinese language office action dated Nov. 20, 2020, issued in application No. TW 108145692.

* cited by examiner

*Primary Examiner* — Graham P Smith
(74) *Attorney, Agent, or Firm* — McClure, Qualey & Rodack, LLP

(57) ABSTRACT

An antenna system includes a first antenna, a second antenna, a third antenna, an isolation metal element, and a nonconductive support element. The isolation metal element is disposed between the first antenna and the second antenna. The third antenna defines a notch region. The second antenna at least partially extends into the notch region. The distance between the third antenna and the second antenna is from 1 mm to 10 mm. The first antenna, the second antenna, the third antenna, and the isolation metal element are all disposed on the nonconductive support element.

20 Claims, 9 Drawing Sheets

ANTENNA SYSTEM

CROSS REFERENCE TO RELATED APPLICATIONS

This Application claims priority of Taiwan Patent Application No. 108145692 filed on Dec. 13, 2019, the entirety of which is incorporated by reference herein.

BACKGROUND OF THE INVENTION

Field of the Invention

The disclosure generally relates to an antenna system, and more particularly, to an antenna system for improving isolation.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

An antenna system is indispensable in a mobile device supporting wireless communication. However, since the interior space of a mobile device is very limited, multiple antennas are usually disposed close to each other, and such a design causes serious interference between antennas. As a result, there is a need to propose a novel antenna system for solving the problem of bad isolation in a conventional antenna system.

BRIEF SUMMARY OF THE INVENTION

In an exemplary embodiment, the invention is directed to an antenna system that includes a first antenna, a second antenna, a third antenna, an isolation metal element, and a nonconductive support element. The isolation metal element is disposed between the first antenna and the second antenna. The third antenna defines a notch region. The second antenna at least partially extends into the notch region. The distance between the third antenna and the second antenna is from 1 mm to 10 mm. The first antenna, the second antenna, the third antenna, and the isolation metal element are all disposed on the nonconductive support element.

In some embodiments, the nonconductive support element has a top surface, a first side surface, a second side surface, a third side surface, and a fourth side surface. The top surface is substantially perpendicular to all of the first side surface, the second side surface, the third side surface, and the fourth side surface.

In some embodiments, the first antenna includes a first radiation element and a second radiation element. The first radiation element has a first feeding point. The second radiation element is coupled to a ground voltage. A first coupling gap is formed between the second radiation element and the first radiation element.

In some embodiments, the first radiation element substantially has an L-shape.

In some embodiments, the second radiation element substantially has a C-shape so that it may at least partially surround the first radiation element.

In some embodiments, the first radiation element extends from the top surface onto the first side surface of the nonconductive support element.

In some embodiments, the second radiation element extends from the top surface through the second side surface, the first side surface, and the third side surface back onto the top surface of the nonconductive support element.

In some embodiments, the isolation metal element substantially has an L-shape.

In some embodiments, the isolation metal element extends from the top surface onto the third side surface of the nonconductive support element.

In some embodiments, the second antenna includes a third radiation element and a fourth radiation element. The third radiation element has a second feeding point. The third radiation element is at least partially positioned inside the notch region of the third antenna. The third radiation element is coupled through the fourth radiation element to a ground voltage.

In some embodiments, the third radiation element extends from the top surface to the third side surface and the fourth side surface of the nonconductive support element.

In some embodiments, the fourth radiation element is disposed on the third side surface of the nonconductive support element.

In some embodiments, the third antenna includes a fifth radiation element and a sixth radiation element. The fifth radiation element has a third feeding point. The sixth radiation element is coupled to a ground voltage, and is adjacent to the notch region. A second coupling gap is formed between the sixth radiation element and the fifth radiation element.

In some embodiments, the fifth radiation element includes a first body portion and a terminal bending portion which are coupled to each other. The angle between the terminal bending portion and the first body portion is smaller than 90 degrees.

In some embodiments, the fifth radiation element extends from the top surface through the fourth side surface to the second side surface of the nonconductive support element.

In some embodiments, the sixth radiation element includes a second body portion, a terminal U-shaped portion, and a terminal H-shaped portion. The second body portion is coupled between the terminal U-shaped portion and the terminal H-shaped portion.

In some embodiments, the sixth radiation element extends from the top surface through the fourth side surface to the second side surface of the nonconductive support element.

In some embodiments, the antenna system further includes a fourth antenna disposed between the first antenna and the third antenna.

In some embodiments, the fourth antenna includes a seventh radiation element. The seventh radiation element has a fourth feeding point, and is coupled to a ground voltage. The seventh radiation element almost has a loop shape.

In some embodiments, both of the first antenna and the third antenna cover an LTE (Long Term Evolution) frequency band. The second antenna covers a GPS (Global Positioning System) frequency band. The fourth antenna covers a Wi-Fi frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

Figure 1A:
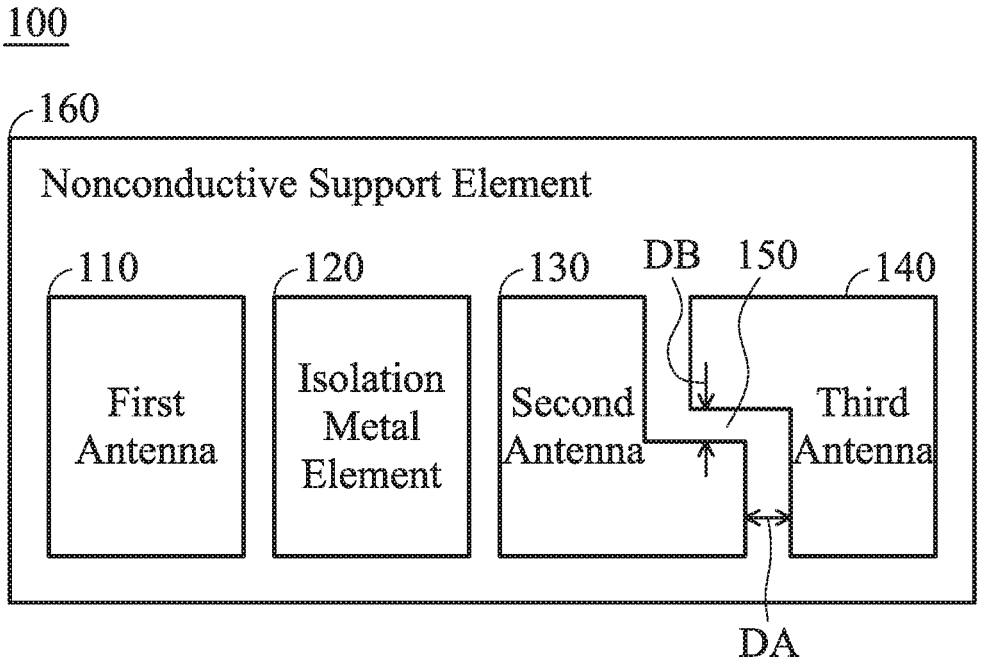
FIGS. 1A-1B are diagrams of an antenna system according to an embodiment of the invention.

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

The following disclosure provides many different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Figure 1B:
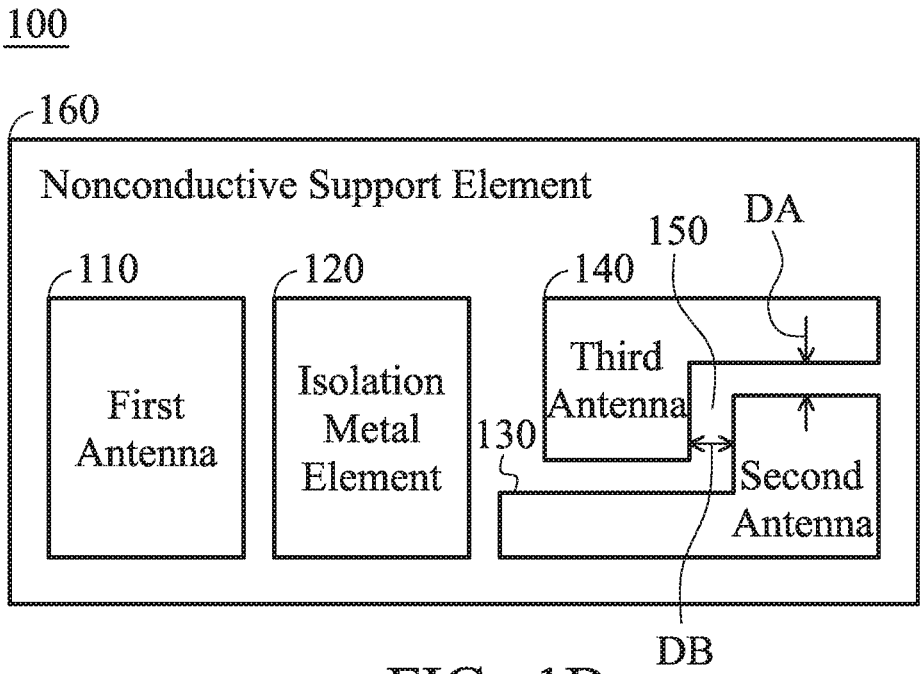

FIGS. 1A-1B are diagrams of an antenna system 100 according to an embodiment of the invention. The antenna system 100 may be applied to a mobile device, such as a smartphone, a tablet computer, or a notebook computer. As shown in FIG. 1, the antenna system 100 at least includes a first antenna 110, an isolation radiation element 120, a second antenna 130, a third antenna 140, and a nonconductive support element 160. The first antenna 110, the second antenna 130, and the third antenna 140 may all be made of metal materials, such as copper, silver, aluminum, iron, or their alloys. The shapes and types of the first antenna 110, the second antenna 130, and the third antenna 140 are not limited in the invention. For example, any of the first antenna 110, the second antenna 130, and the third antenna 140 may be a monopole antenna, a dipole antenna, a loop antenna, a patch antenna, a helical antenna, a coupled-fed antenna, or a PIFA (Planar Inverted F Antenna), but it is not limited thereto. The isolation metal element 120 is disposed between the first antenna 110 and the second antenna 130, so as to reduce the interference between the first antenna 110 and the second antenna 130. The third antenna 140 defines a notch region 150. The second antenna 130 at least partially extends into the notch region 150. The distances DA and DB between the third antenna 140 and the second antenna 130 are from 1 mm to 10 mm. The existence of the third antenna 140 helps to reduce the interference between the first antenna 110 and the second antenna 130. The first antenna 110, the second antenna 130, the third antenna 140, and the isolation metal element 120 are all disposed on the nonconductive support element 160. In some embodiments, both of the first antenna 110 and the third antenna 140 can cover an LTE (Long Term Evolution) frequency band, and the second antenna 130 can cover a GPS (Global Positioning System) frequency band. According to practical measurements, such a design prevents the double-frequency noise of the second antenna 130 from negatively affecting the radiation performance of the first antenna 110, thereby improving the whole communication quality of the antenna system 100.

The following embodiments will introduce the detailed features of the antenna system 100. It should be understood that these figures and descriptions are merely exemplary, rather than limitations of the patent scope of the invention.

Figure 2:
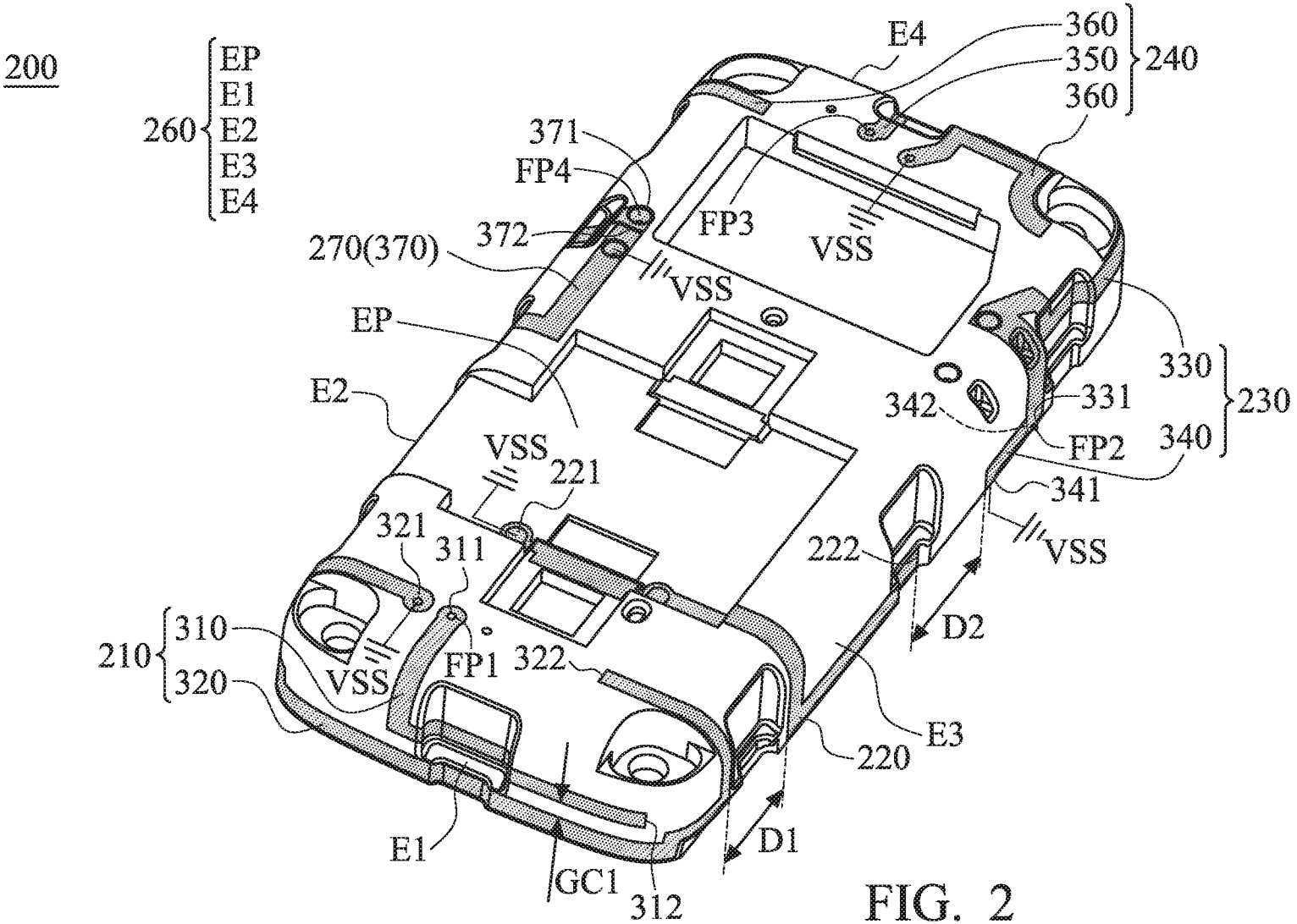
FIG. 2 is a perspective view of an antenna system according to an embodiment of the invention.
Figure 3:
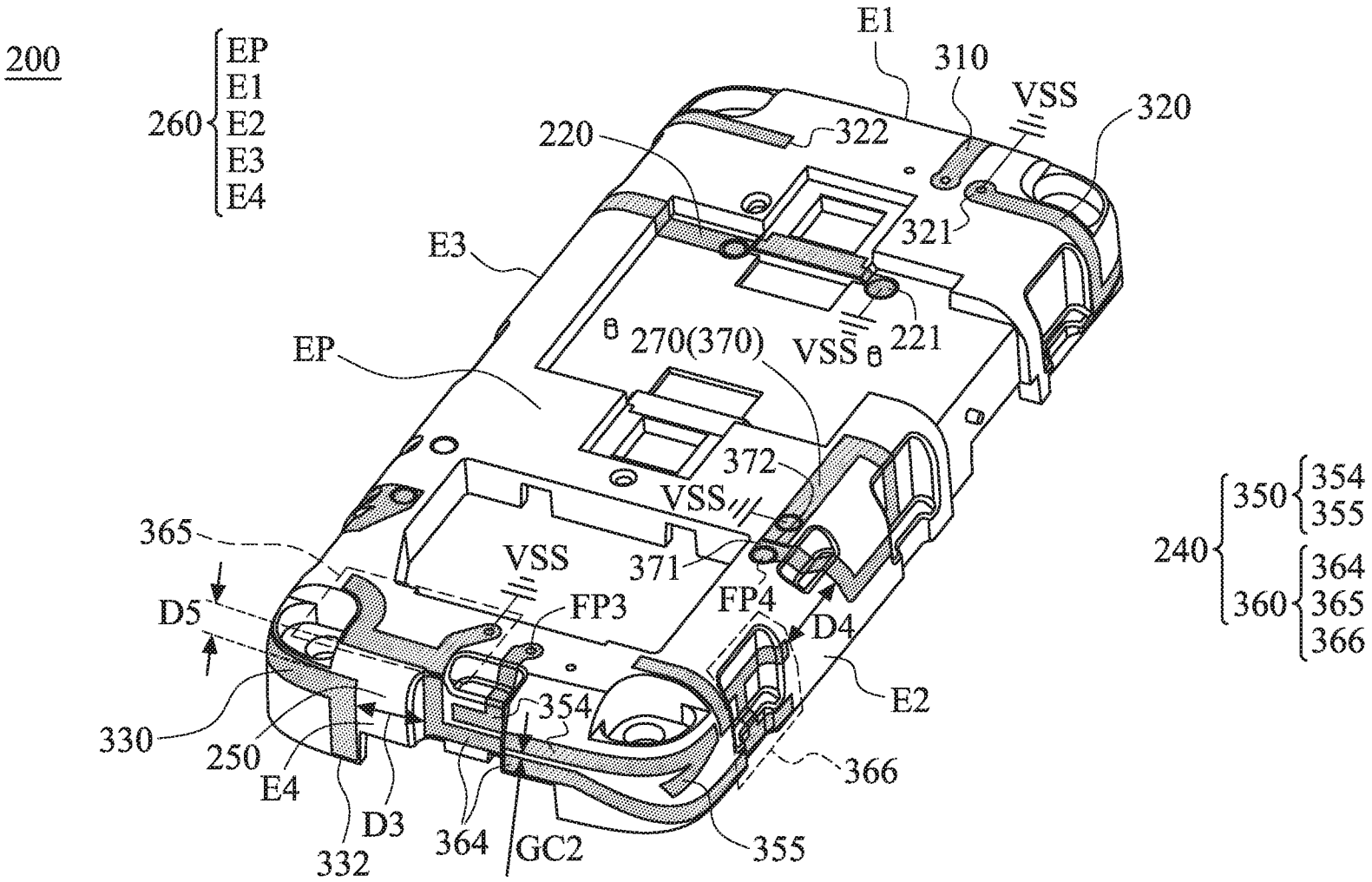
FIG. 3 is a perspective view of an antenna system according to an embodiment of the invention.
Figure 4A:
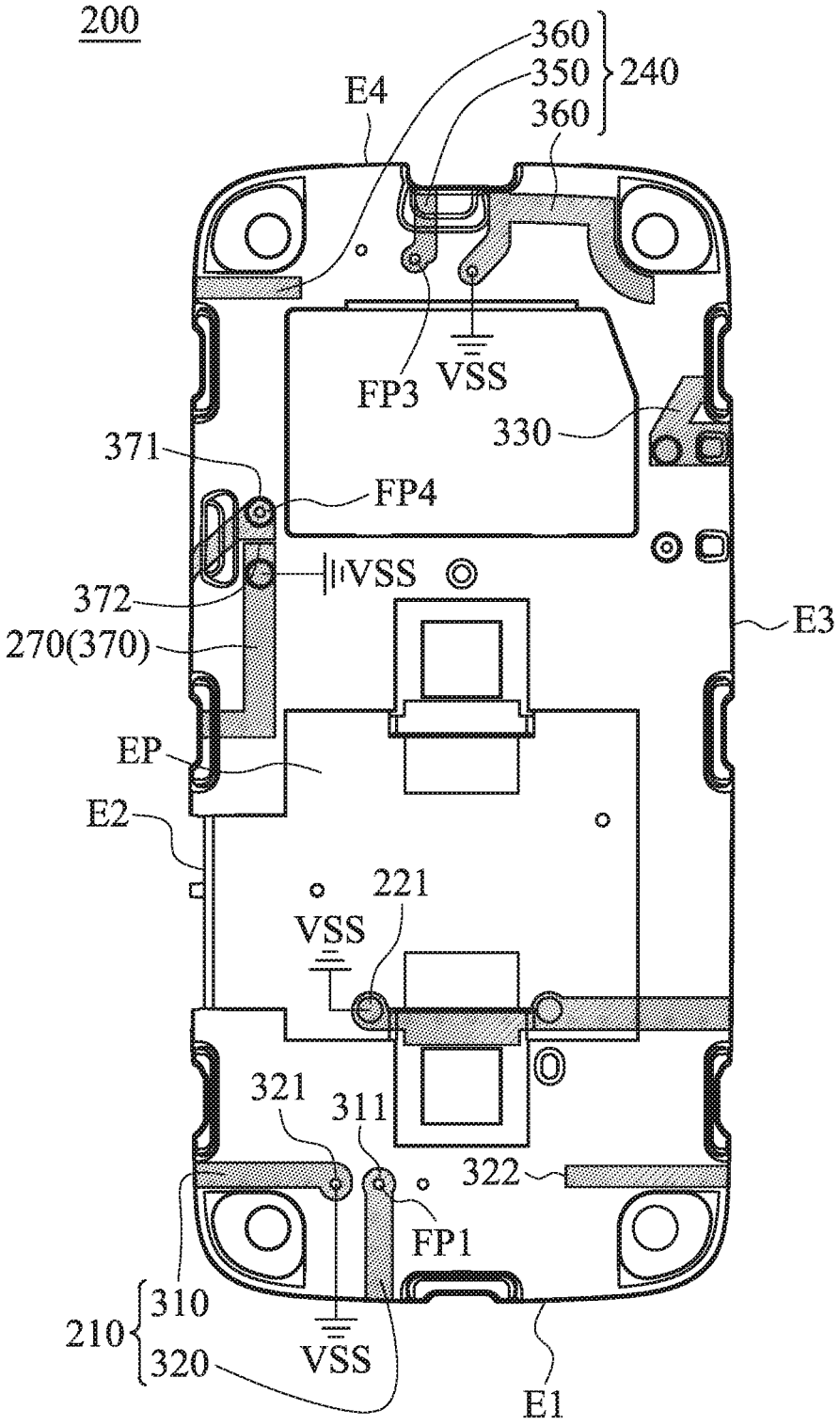
FIGS. 4A-4E are a variety of views of an antenna system according to an embodiment of the invention.
Figure 4B:
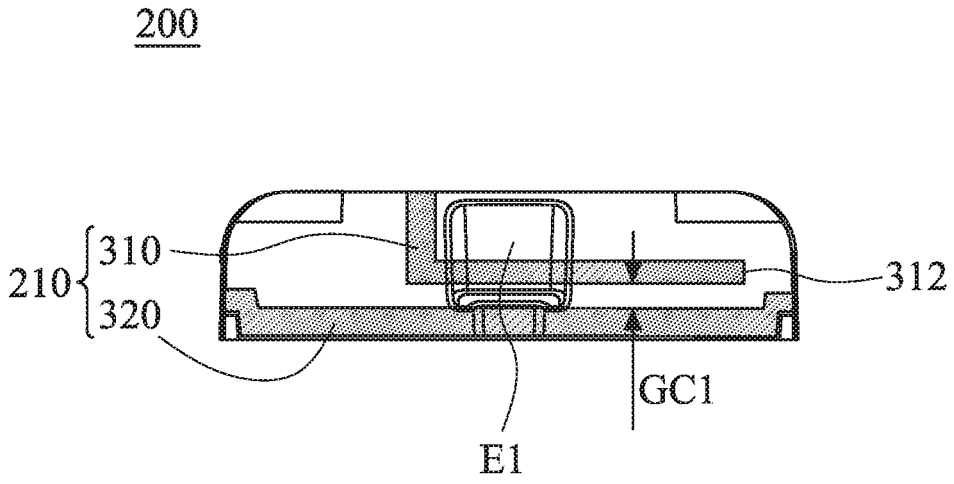
Figure 4C:
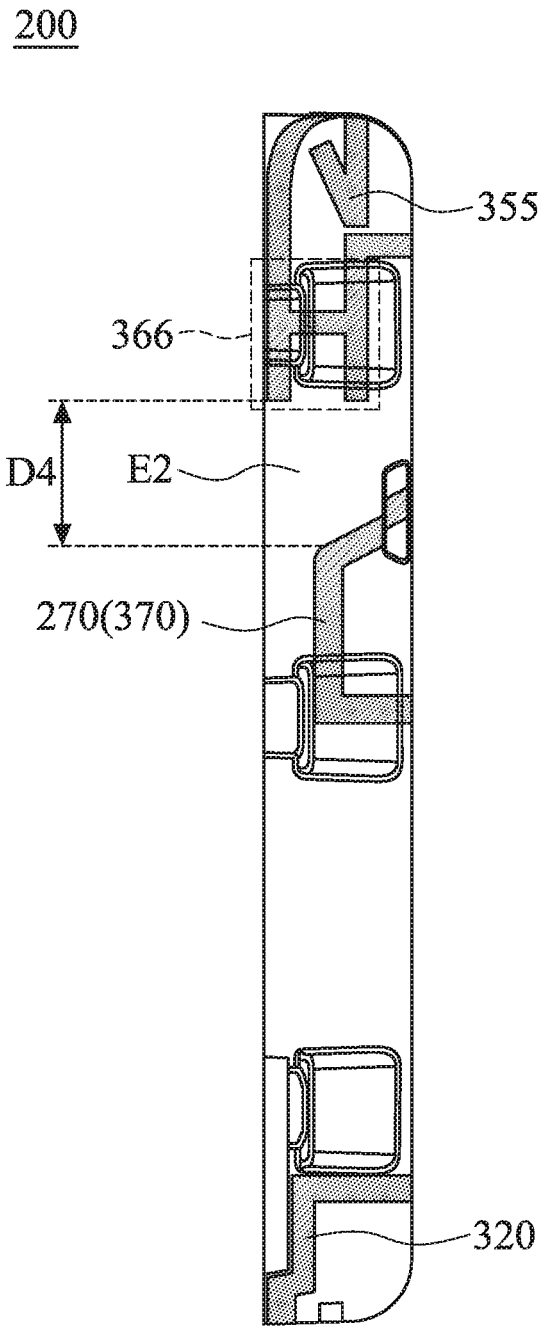
Figure 4D:
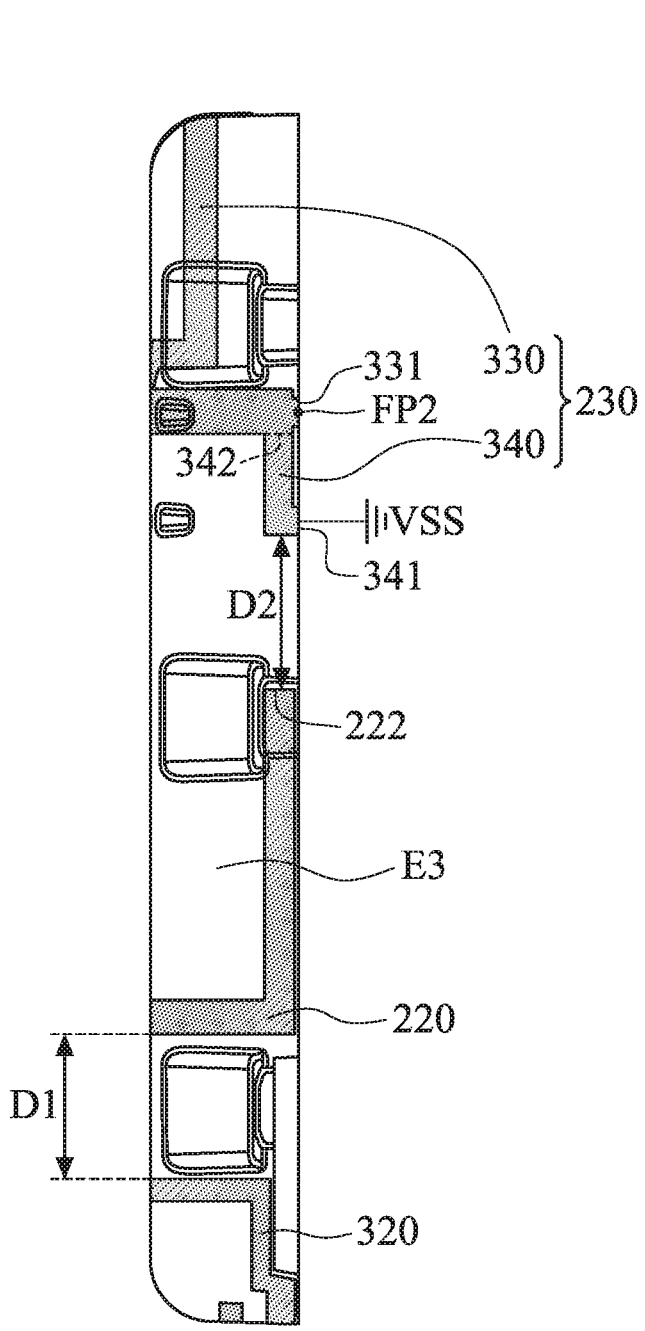
Figure 4E:
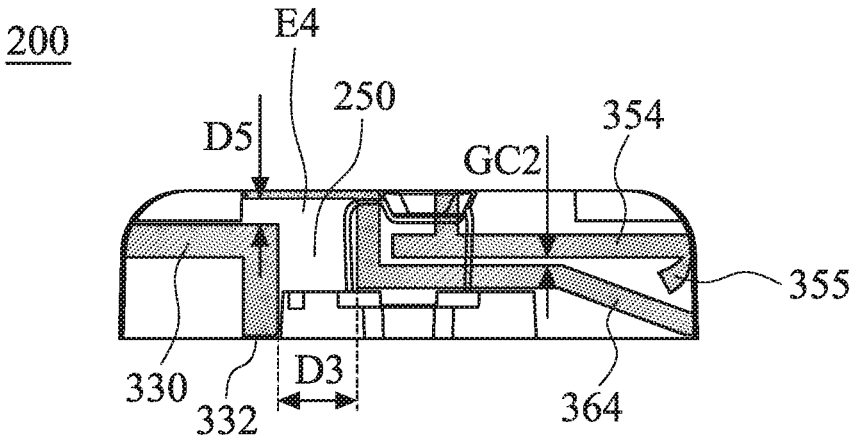

FIG. 2 is a perspective view of an antenna system 200 according to an embodiment of the invention. FIG. 3 is a perspective view of the antenna system 200 according to an embodiment of the invention (from a different viewing angle). FIGS. 4A-4E are a variety of views of the antenna system 200 according to an embodiment of the invention. Please refer to FIGS. 2, 3 and 4. In the embodiment of FIGS. 2, 3 and 4, the antenna system 200 includes a first antenna 210, an isolation metal element 220, a second antenna 230, a third antenna 240, a nonconductive support element 260, and a fourth antenna 270. The first antenna 210, the second antenna 230, the third antenna 240, and the fourth antenna 270 may all be made of metal materials. The nonconductive support element 260 may be a 3D (Three-dimensional) structure. The first antenna 210, the second antenna 230, the third antenna 240, and the fourth antenna 270, and the isolation metal element 220 are distributed over the surfaces of the nonconductive support element 260. However, the invention is not limited thereto. In alternative embodiments, adjustments are made such that the nonconductive support element 260 is a planar structure for carrying all of the first antenna 210, the second antenna 230, the third antenna 240, and the fourth antenna 270, and the isolation metal element 220.

The nonconductive support element 260 may substantially have a cuboid shape. Specifically, the nonconductive support element 260 has a top surface EP, a first side surface E1, a second side surface E2, a third side surface E3, and a fourth side surface E4. The top surface E1 is substantially perpendicular to all of the first side surface E1, the second side surface E2, the third side surface E3, and the fourth side surface E4. In the nonconductive support element 260, the first side surface E1 and the fourth side surface E4 are opposite to and substantially parallel to each other. The second side surface E2 and the third side surface E3 are opposite to and substantially parallel to each other. The top surface EP is connected to all of the first side surface E1, the second side surface E2, the third side surface E3, and the fourth side surface E4. It should be noted that the top surface EP, the first side surface E1, the second side surface E2, the third side surface E3, and the fourth side surface E4 as described above may be smooth planes or slightly uneven surfaces, without affecting the performance of the invention.

The first antenna 210 includes a first radiation element 310 and a second radiation element 320. The first radiation element 310 may substantially have an L-shape. The first radiation element 310 may extend from the top surface EP onto the first side surface E1 of the nonconductive support element 260. Specifically, the first radiation element 310 has a first end 311 and a second end 312. A first feeding point FP1 is positioned at the first end 311 of the first radiation element 310. The second end 312 of the first radiation element 310 is an open end. The first end 311 of the first radiation element 310 may be positioned on the top surface EP of the nonconductive support element 260. The second end 312 of the first radiation element 310 may be positioned on the first surface E1 of the nonconductive support element 260. The first feeding point FP1 may be further coupled to a first signal source (not shown). The first signal source may be an RF (Radio Frequency) module for exciting the first antenna 210.

The second radiation element 320 may substantially have a C-shape so that it may at least partially surround the first radiation element 310. The second radiation element 320 may extend from the top surface EP through the second side surface E2, the first side surface E1, and the third side surface E3 back onto the top surface EP of the nonconductive support element 260. Specifically, the second radiation element 320 has a first end 321 and a second end 322. The first end 321 of the second radiation element 320 is coupled to a ground voltage VSS. The second end 322 of the second radiation element 320 is an open end. The ground voltage VSS may be provided by a system ground plane (not shown) of the antenna system 200. The first end 321 of the second radiation element 320 is adjacent to the first feeding point FP1. It should be noted that the term "adjacent" or "close" over the disclosure means that the distance (spacing) between two corresponding elements is smaller than a predetermined distance (e.g., 5 mm or shorter), but usually does not mean that the two corresponding elements directly touch each other (i.e., the aforementioned distance/spacing therebetween is reduced to 0). A first coupling gap GC1 may be formed between the second radiation element 320 and the second end 312 of the first radiation element 310, such that the second radiation element 320 is excited by the first radiation element 310 using a coupling mechanism. The first end 321 and the second end 322 of the second radiation element 320 may both positioned on the top surface EP of the nonconductive support element 260. The first end 321 and the second end 322 of the second radiation element 320 may extend in opposite directions and toward each other.

The isolation metal element 220 may substantially have an L-shape. The isolation metal element 220 may extend from the top surface EP onto the third side surface E3 of the nonconductive support element 260. Specifically, the isolation metal element 220 has a first end 221 and a second end 222. The first end 221 of the isolation metal element 220 is coupled to the ground voltage VSS. The second end 222 of the isolation metal element 220 is an open end, which extends toward the second antenna 230. The isolation metal element 220 is positioned between the first antenna 210 and the second antenna 230. The first end 221 of the isolation metal element 220 is positioned on the top surface EP of the nonconductive support element 260. The second end 222 of the isolation metal element 220 is positioned on the third side surface E3 of the nonconductive support element 260. In alternative embodiments, the isolation metal element 220 has a plurality of shorting points coupled to the ground voltage VSS, and it is not limited to the design of coupling the first end 221 of the isolation metal element 220 to the ground voltage VSS.

The second antenna 230 includes a third radiation element 330 and a fourth radiation element 340. The third radiation element 330 may substantially have a meandering shape. The third radiation element 330 may extend from the top surface EP to the third side surface E3 and the fourth side surface E4 of the nonconductive support element 260. Specifically, the third radiation element 330 has a first end 331 and a second end 332. A second feeding point FP2 is positioned at the first end 331 of the third radiation element 330. The second end 332 of the third radiation element 330 is an open end, which can extend into a notch region 250 defined by the third antenna 240. The second feeding point FP2 may be further coupled to a second signal source (not shown). The second signal source may be an RF module for exciting the second antenna 230. The third end 331 of the third radiation element 330 may be positioned on the third side surface E3 of the nonconductive support element 260. The second end 332 of the third radiation element 330 may be positioned on the fourth side surface E4 of the nonconductive support element 260.

The fourth radiation element 340 may substantially have an L-shape. The whole fourth radiation element 340 may be disposed on the third side surface E3 of the nonconductive support element 260. Specifically, the fourth radiation element 340 has a first end 341 and a second end 342. The first end 341 of the fourth radiation element 340 is coupled to the ground voltage VSS. The second end 342 of the fourth radiation element 340 is coupled to the first end 331 of the third radiation element 330. Thus, the third radiation element 330 is coupled through the fourth radiation element 340 to the ground voltage VSS.

The third antenna 240 includes a fifth radiation element 350 and a sixth radiation element 360. The fifth radiation element 350 may have an irregular shape. The fifth radiation element 350 may extend from the top surface EP through the fourth side surface E4 to the second side surface E2 of the nonconductive support element 260. Specifically, the fifth radiation element 350 includes a first body portion 354 and a terminal bending portion 355 which are coupled to each other. A third feeding point FP3 is positioned at the first body portion 354 of the fifth radiation element 350. The angle θ1 between the terminal bending portion 355 and the first body portion 354 of the fifth radiation element 350 is smaller than 90 degrees. The third feeding point FP3 may be further coupled to a third signal source (not shown). The third signal source may be an RF module for exciting the third antenna 240.

The sixth radiation element 360 may have an irregular shape. The sixth radiation element 360 may extend from the top surface EP through the fourth side surface E4 to the second side surface E2 of the nonconductive support element 260. Specifically, the sixth radiation element 260 includes a second body portion 364, a terminal U-shaped portion 365, and a terminal H-shaped portion 366. The second body portion 364 is coupled between the terminal U-shaped portion 365 and the terminal H-shaped portion 366. The terminal U-shaped portion 365 of the sixth radiation element 360 is coupled to the ground voltage VSS. A second coupling gap GC2 may be formed between the second body portion 364 of the sixth radiation element 360 and the first body portion 354 of the fifth radiation element 350, such that the sixth radiation element 360 is excited by the fifth radiation element 350 using a coupling mechanism. The second body portion 364 and the terminal U-shaped portion 365 of the sixth radiation element 360 are both adjacent to the notch region 250. The notch region 250 may substantially have a rectangular shape for accommodating the second end 332 of the third radiation element 330. The whole terminal U-shaped portion 365 of the sixth radiation element 360 may be positioned on the top surface EP of the nonconductive support element 260. The whole terminal H-shaped portion 366 of the sixth radiation element 360 may be positioned on the second side surface E2 of the nonconductive support element 260.

The fourth antenna 270 is disposed between the first antenna 210 and the third antenna 240. The fourth antenna 270 includes a seventh radiation element 370. The seventh radiation element 370 may almost have a loop shape. The seventh radiation element 370 may extend from the top surface EP through the second side surface E2 back to the top surface EP of the nonconductive support element 260. Specifically, the seventh radiation element 370 has a first end 371 and a second end 372. A fourth feeding point FP4 is positioned at the first end 371 of the fourth radiation element 370. The second end 372 of the seventh radiation element 370 is coupled to the ground voltage VSS, and is adjacent to the first end 371 of the seventh radiation element 370. The fourth feeding point FP4 may be further coupled to a fourth signal source (not shown). The fourth signal source may be an RF module for exciting the fourth antenna 270. The first end 371 and the second end 372 of the fourth radiation element 370 may be both positioned on the top surface EP of the nonconductive support element 260.

In some embodiments, both of the first antenna 210 and the third antenna 240 cover an LTE (Long Term Evolution) frequency band, the second antenna 230 covers a GPS (Global Positioning System) frequency band, and the fourth antenna 270 covers a Wi-Fi frequency band. For example, the aforementioned LTE frequency band may include a low-frequency interval from 746 MHz (or 787 MHz) to 894 MHz, and a high-frequency interval from 1710 MHz to 2170 MHz. The aforementioned GPS frequency band may be around 1575 MHz. The aforementioned Wi-Fi frequency band may be from 2400 MHz 2500 MHz. Accordingly, the antenna system 200 can support at least the multiband operations of LTE, GPS and Wi-Fi.

In some embodiments, the operation principles of the antenna system 200 may be described as follows. The isolation metal element 220 is positioned between the first antenna 210 and the second antenna 230, so as to reduce the interference between the first antenna 210 and the second antenna 230. Similarly, the third antenna 240 is also positioned between the first antenna 210 and the second antenna 230, so as to reduce the interference between the first antenna 210 and the second antenna 230. It should be noted that the maximum current-density position of the second antenna 230 is adjacent to the second end 332 of the third radiation element 330, and the second end 332 of the third radiation element 330 extends into the notch region 250 defined by the third antenna 240. According to practical measurements, the third antenna 240 is considered as an equivalent isolation metal element which prevents the double-frequency noise of the second antenna 230 from negatively affecting the radiation performance of the first antenna 210, thereby improving the whole communication quality of the antenna system 200.

Figure 5:
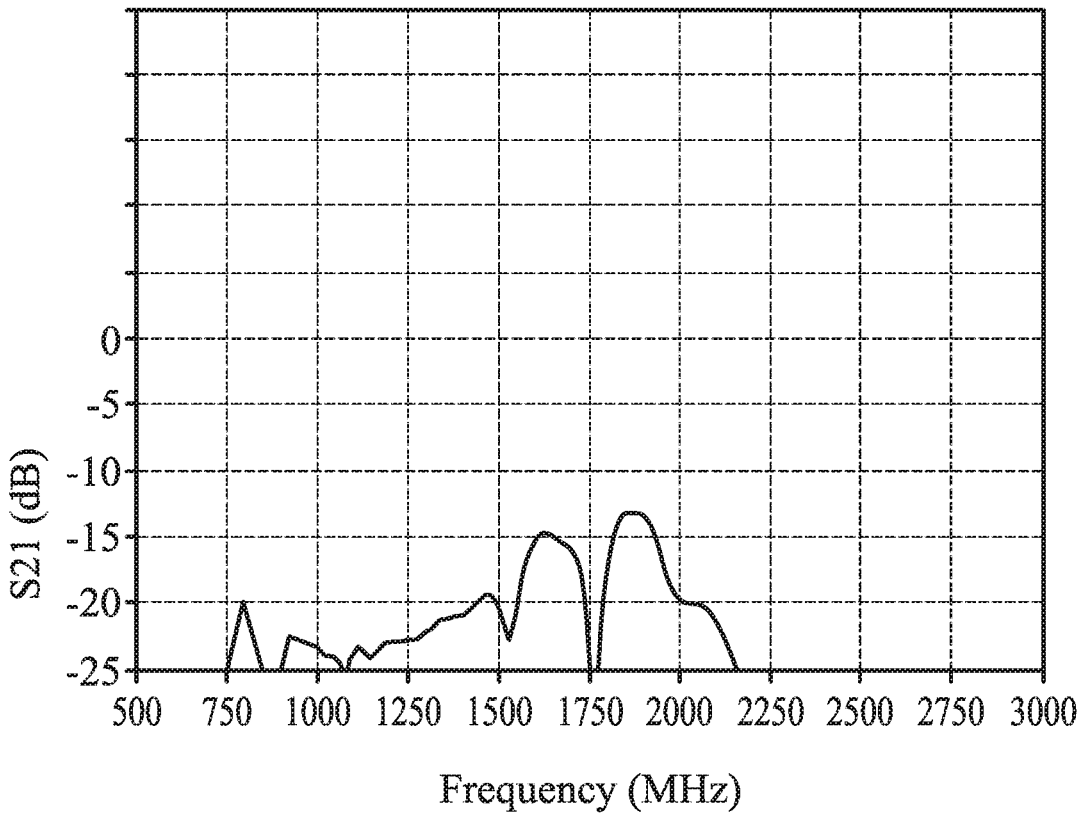
FIG. 5 is a diagram of an S-parameter of an antenna system according to an embodiment of the invention.

FIG. 5 is a diagram of an S-parameter of the antenna system 200 according to an embodiment of the invention. In the embodiment of FIG. 5, the first feeding point FP1 of the first antenna 210 is set as a first port (Port 1), and the second feeding point FP2 of the second antenna 230 is set as a second port (Port 2). According to the measurement of FIG. 5, the S21 parameter between the first antenna 210 and the second antenna 230 is lower than −18 dB within the aforementioned LTE and GPS frequency bands, and such isolation can meet the requirements of practical applications of general mobile communication devices.

In some embodiments, the element sizes of the antenna system 200 are described as follows. The length of the first radiation element 310 (i.e., the length from the first end 311 to the second end 312) may be substantially equal to 0.25 wavelength (λ/4) of the high-frequency interval of the LTE frequency band. The length of the second radiation element 320 (i.e., the length from the first end 321 to the second end 322) may be substantially equal to 0.25 wavelength (λ/4) of the low-frequency interval of the LTE frequency band. The width of the first coupling gap GC1 may be from 1.5 mm to 2 mm. The length of the isolation metal element 220 (i.e., the length from the first end 221 to the second end 222) may be substantially equal to 0.25 wavelength (λ/4) of the GPS frequency band. The length of the third radiation element 330 (i.e., the length from the first end 331 to the second end 332) may be substantially equal to 0.25 wavelength (λ/4) of the GPS frequency band. The length of the fifth radiation element 350 (i.e., the total length of the first body portion 354 and the terminal bending portion 355) may be substantially equal to 0.25 wavelength (λ/4) of the high-frequency interval of the LTE frequency band. The length of the sixth radiation element 360 (i.e., the total length of terminal U-shaped portion 365, the second body portion 364, and the terminal H-shaped portion 366) may be substantially equal to 0.25 wavelength (λ/4) of the low-frequency interval of the LTE frequency band. The width of the second coupling gap GC2 may be shorter than or equal to 1 mm. In the fifth radiation element 350, the angle θ1 between the terminal bending portion 355 and the first body portion 354 may be from 0 to 45 degrees. The length of the seventh radiation element 370 (i.e., the length from the first end 371 to the second end 372) may be substantially equal to 0.5 wavelength (λ/2) of the Wi-Fi frequency band. The distance D1 between the isolation metal element 220 and the second radiation element 320 of the first antenna 210 may be longer than or equal to 5 mm. The distance D2 between the isolation metal element 220 and the fourth radiation element 340 of the second antenna 230 may be longer than or equal to 5 mm. The distance D3 between the third radiation element 330 of the second antenna 230 and the sixth radiation element 360 of the third antenna 240 may be from 1 mm to 10 mm (e.g., specifically from 1 mm to 5 mm, or from 2 mm to 3 mm). The distance D4 between the sixth radiation element 360 of the third antenna 240 and the seventh radiation element 370 of the fourth antenna 270 may be longer than or equal to 5 mm. The distance D5 between the third radiation element 330 of the second antenna 230 and the sixth radiation element 360 of the third antenna 240 may be from 1 mm to 10 mm (e.g., specifically from 1 mm to 5 mm, or from 2 mm to 3 mm). The above ranges of element sizes are calculated and obtained according to many experiment results, and they help to optimize the isolation, operation bandwidth, and impedance matching of the antenna system 200.

The invention proposes a novel antenna system. In comparison to the conventional design, the invention has at least the advantages of small size, wide bandwidth, high isolation, and low manufacturing cost, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna system of the invention is not limited to the configurations of FIGS. 1-5. The invention may include any one or more features of any one or more embodiments of FIGS. 1-5. In other words, not all of the features displayed in the figures should be implemented in the antenna system of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna system, comprising:

a first antenna;

a second antenna;

an isolation metal element, disposed between the first antenna and the second antenna;

a third antenna, defining a notch region, wherein the second antenna at least partially extends into the notch region, and a distance between the third antenna and the second antenna is from 1 mm to 10 mm; and a nonconductive support element, wherein the first antenna, the second antenna, the third antenna, and the isolation metal element are disposed on the nonconductive support element.

2. The antenna system as claimed in claim 1, wherein the nonconductive support element has a top surface, a first side surface, a second side surface, a third side surface, and a fourth side surface, and the top surface is substantially perpendicular to the first side surface, the second side surface, the third side surface, and the fourth side surface.

3. The antenna system as claimed in claim 2, wherein the first antenna comprises:

a first radiation element, having a first feeding point; and a second radiation element, coupled to a ground voltage, wherein a first coupling gap is formed between the second radiation element and the first radiation element.

4. The antenna system as claimed in claim 3, wherein the first radiation element substantially has an L-shape.

5. The antenna system as claimed in claim 3, wherein the second radiation element substantially has a C-shape for at least partially surrounding the first radiation element.

6. The antenna system as claimed in claim 3, wherein the first radiation element extends from the top surface onto the first side surface of the nonconductive support element.

7. The antenna system as claimed in claim 3, wherein the second radiation element extends from the top surface through the second side surface, the first side surface, and the third side surface back onto the top surface of the nonconductive support element.

8. The antenna system as claimed in claim 1, wherein the isolation metal element substantially has an L-shape.

9. The antenna system as claimed in claim 2, wherein the isolation metal element extends from the top surface onto the third side surface of the nonconductive support element.

10. The antenna system as claimed in claim 2, wherein the second antenna comprises:

a third radiation element, having a second feeding point, wherein the third radiation element is at least partially positioned inside the notch region of the third antenna; and a fourth radiation element, wherein the third radiation element is coupled through the fourth radiation element to a ground voltage.

11. The antenna system as claimed in claim 10, wherein the third radiation element extends from the top surface to the third side surface and the fourth side surface of the nonconductive support element.

12. The antenna system as claimed in claim 10, wherein the fourth radiation element is disposed on the third side surface of the nonconductive support element.

13. The antenna system as claimed in claim 2, wherein the third antenna comprises:

a fifth radiation element, having a third feeding point; and a sixth radiation element, coupled to a ground voltage, and disposed adjacent to the notch region, wherein a second coupling gap is formed between the sixth radiation element and the fifth radiation element.

14. The antenna system as claimed in claim 13, wherein the fifth radiation element comprises a first body portion and a terminal bending portion coupled to each other, and an angle between the terminal bending portion and the first body portion is smaller than 90 degrees.

15. The antenna system as claimed in claim 13, wherein the fifth radiation element extends from the top surface through the fourth side surface to the second side surface of the nonconductive support element.

16. The antenna system as claimed in claim 13, wherein the sixth radiation element comprises a second body portion, a terminal U-shaped portion, and a terminal H-shaped portion, and the second body portion is coupled between the terminal U-shaped portion and the terminal H-shaped portion.

17. The antenna system as claimed in claim 13, wherein the sixth radiation element extends from the top surface through the fourth side surface to the second side surface of the nonconductive support element.

18. The antenna system as claimed in claim 1, further comprising:

a fourth antenna, disposed between the first antenna and the third antenna.

19. The antenna system as claimed in claim 18, wherein the fourth antenna comprises:

a seventh radiation element, having a fourth feeding point, and coupled to a ground voltage, wherein the seventh radiation element almost has a loop shape.

20. The antenna system as claimed in claim 18, wherein both the first antenna and the third antenna cover an LTE (Long Term Evolution) frequency band, the second antenna covers a GPS (Global Positioning System) frequency band, and the fourth antenna covers a Wi-Fi frequency band.

* * * * *